United States Patent [19]

Raible

[11] 4,150,621

[45] Apr. 24, 1979

[54] PRINTING PRESS HAVING PLURALITY OF SEPARABLE INKING MECHANISMS

[75] Inventor: Hermann Raible, St. Georgen, Fed. Rep. of Germany

[73] Assignee: Mathias Bäuerle GmbH, Fed. Rep. of Germany

[21] Appl. No.: 835,001

[22] Filed: Sep. 20, 1977

[30] Foreign Application Priority Data

Sep. 22, 1976 [DE] Fed. Rep. of Germany ..... 2642580

[51] Int. Cl.[2] ..... B41F 31/30; B41L 27/08

[52] U.S. Cl. ..... 101/207; 101/209; 101/350; 101/137

[58] Field of Search ..... 101/205, 206, 207, 208, 101/209, 210, 349, 350, 351, 137, 199, 352, 136, 137; 118/258, 259

[56] References Cited

U.S. PATENT DOCUMENTS

| | | | |
|---|---|---|---|
| 443,306 | 12/1890 | Townsend | 101/199 |
| 587,253 | 7/1897 | Adler | 101/171 |
| 1,024,473 | 4/1912 | Firm | 101/137 |
| 2,232,274 | 2/1941 | Robbins | 101/363 |
| 2,823,607 | 2/1958 | Butcher et al. | 101/363 |
| 3,361,062 | 1/1968 | Proctor | 101/350 |
| 3,712,215 | 1/1973 | Cunningham | 101/208 |
| 3,734,014 | 5/1973 | Oda | 101/205 |

FOREIGN PATENT DOCUMENTS

| | | | |
|---|---|---|---|
| 1140205 | 11/1962 | Fed. Rep. of Germany | 101/352 |

*Primary Examiner*—J. Reed Fisher
*Attorney, Agent, or Firm*—McGlew and Tuttle

[57] ABSTRACT

A printing press, comprises a plate cylinder, over which material to be printed is passed. An inking mechanism support member is located adjacent the plate member and a plurality of separate inking mechanisms are mounted on the support member and each includes an ink fountain, a fountain roller cooperatively associated with the ink fountain for picking up ink therefrom, a spreader roller cooperatively engageable with the fountain roller to pick up the ink therefrom, and an application roller positioned between the spreader roller and the plate cylinder for applying ink from the spreader roller to the material passed over the said plate cylinder. The individual ink mechanisms may be selectively positioned in an operative position with its application roller in cooperative engagement with the plate cylinder.

6 Claims, 9 Drawing Figures

FIG. 4
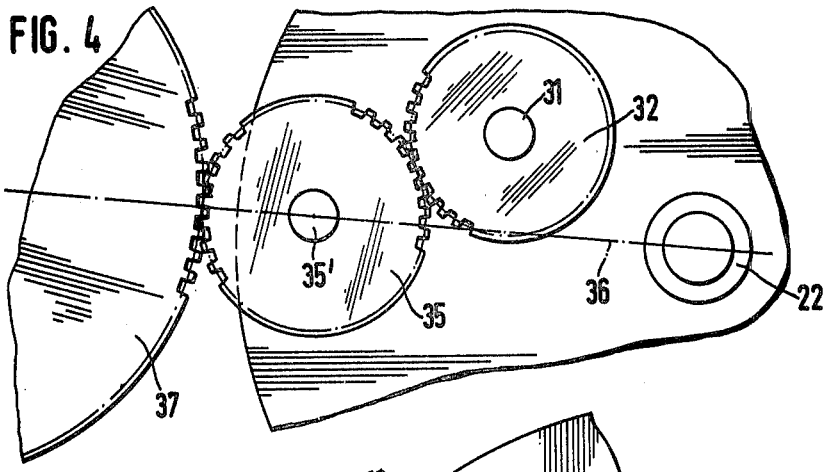
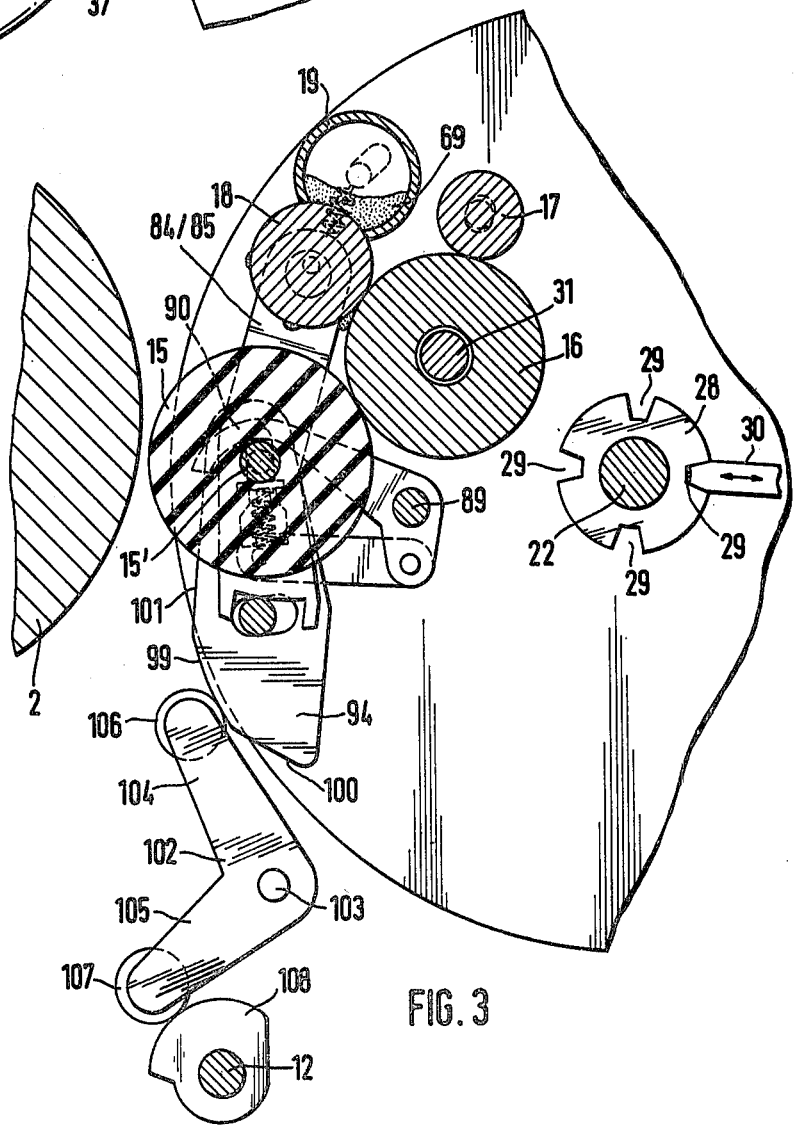
FIG. 3

FIG. 9
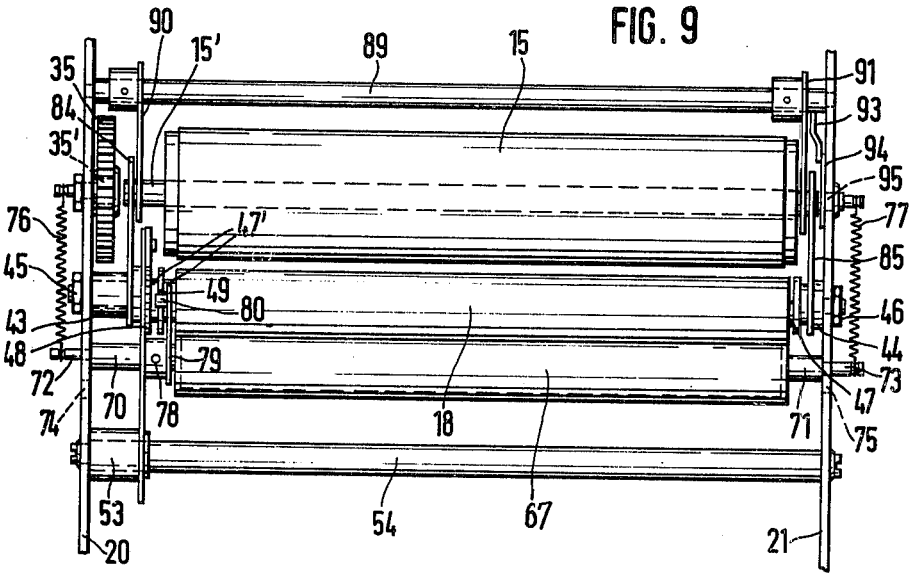
FIG. 5
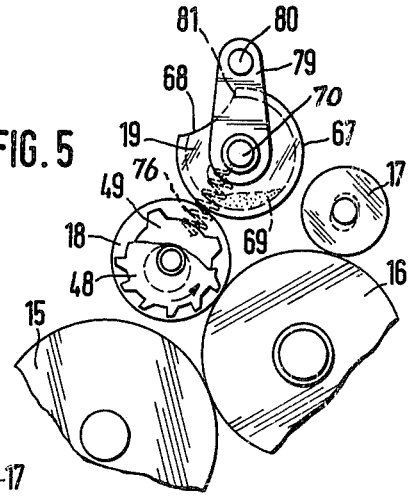
FIG. 6
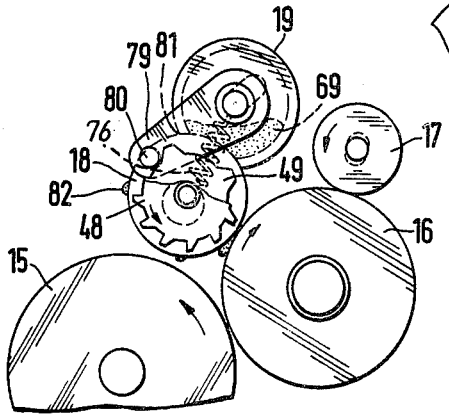
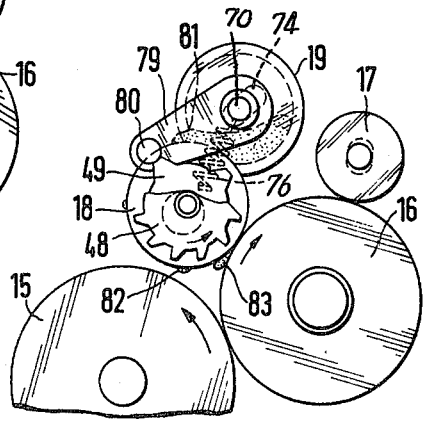
FIG. 7

PRINTING PRESS HAVING PLURALITY OF SEPARABLE INKING MECHANISMS

FIELD AND BACKGROUND OF THE INVENTION

The present invention relates in general to rotary printing presses and, in particular, to a new and useful office offset printing press, equipped with an inking mechanism comprising a closed ink fountain and a fountain roller which is driven for rotary motion and which segmentally projects into the fountain, and by which the ink is removed in metered quantities and transferred to a spreader roller which is operatively connected to the plate cylinder by means of a contacting application roller which can be applied to the plate cylinder.

DESCRIPTION OF THE PRIOR ART

Aside from the well-known rotary printing presses and office offset printing presses of this kind which are always equipped with a single inking mechanism and therefore, as a rule, can only print one color, a film inking mechanism for rotary printing presses is known from German Pat. No. 1,132,934. Such a mechanism includes a main ink fountain asociated with a fountain roller which extends over the entire width of the press and has a plurality of attached ink fountains with fountain rollers extending, for example, over the width of a sheet. The machine includes a driven, continuously rotating, transfer roller which is multisectional in the axial direction. With such a lifter-free film inking mechanism, it is possible to make partial prints which do not extend over the entire width of the inking mechanism. For multicolor or decorative printing, however, such inking mechanisms are not suitable.

SUMMARY OF THE INVENTION

Devices with which from a given multicolor pattern, separate printing plates for the three basic colors can be produced for making multicolor prints, for example, in an office offset printing press are also known. The present invention is an improvement of such devices and includes a rotary printing press or office offset printing press with which it is possible to make multicolor prints in a simple manner.

Rotary printing presses and, particularly, office offset printing presses of the prior art are equipped with only one inking mechanism and can be employed for multicolor printing but only in a very complicated manner. That is, it is necessary to either clean the inking mechanism after the printing operation with one color and then fill it with the following color, or to exchange the entire inking mechanism several times for another which contains the respective next color. Another possibility is to provide a complete, separate press for each of the basic colors. Such methods are not only uneconomical but certainly cannot be practiced under office conditions since the cleaning or exchange of an inking mechanism requires skilled operators and, as a rule, an office is equipped with only one offset printing press.

In accordance with the invention, a plurality of inking mechanisms are provided, each of which comprises a closed ink fountain, a fountain roller, a spreader roller and an applicator roller, which are carried by a supporrting frame mounted for rotation on the machine frame and are disposed at locations radially equally spaced from a common axis of rotation, and which can each be individually brought into their working position relative to the plate cylinder.

Such a rotary press or office offset printing press makes it possible to produce multicolor prints in the same simple manner as one color, for example, black prints, by providing that each of the inking mechanisms mounted on the supporting frame is inked with another color, for example, three with the basic colors blue, yellow, red, and a fourth mechanism with black. The individual inking mechanisms can be brought into their working positions in a simple manner without having to remove the other inking mechanisms from the press.

The supporting frame structure provided comprises two supporting discs mounted on a common shaft and spaced apart by a distance corresponding to the width of an inking mechanism. The frame can be fixed in the working positions of each of the individual inking mechanisms. In consequence, all the inking mechanisms can be disposed in space in a suitable manner. The displacement of the individual inking mechanisms into their working positions is reduced to a simple rotary motion of the supporting frame so that no particular arrangement is needed for a simultaneous introduction of one inking mechanism into its working position and removing of the other inking mechanism from its hitherto occupied working position.

While the closed ink fountains of the prior art comprise box-like hollow bodies with the fountain roller rotatably mounted at the front sides thereof, for example, as disclosed in German Offenlegunsschrift No. 1,938,525 or East German Pat. No. 25,340, the invention provides an ink fountain for each inking mechanism which comprises a tube closed at both its sides and having a cutout extending over the entire length of the tube and conformable to the fountain roller, and which is mounted for rotation relative to the fountain roller and for radial motion against the action of a spring.

Such an ink fountain has several advantages. It can be easily manufactured, occupies little space and, consequently, is substantially more suitable for a rugged construction than the box-like fountains of the prior art. In addition, it securely prevents an unintentional escape of the ink contained therein. The particular mounting makes it possible to turn the cutout, which normally is closed by the fountain roller, away from the roller by a simple manipulation, in order to supply the fountain with ink, or to adjust it for delivering a metered ink quantity during the printing operation.

In accordance with a development of the invention, and to obtain a metered ink delivery during the printing operation, it is further provided that the longitudinal edge of the cutout at the exit side of the ink can be lifted temporarily from the fountain roller by means of a lever arm secured to the tubular fountain and a cam disc which can be rotated and actuates the lever arm.

This offers an advantageous possibility of not only exactly dosing the quantity of ink to be delivered to the spreader roller, but also of removing the ink from the fountain and delivering it to the spreader roller at the circumference of the fountain roller in the form of a drop extending over the entire length of the fountain roller, so that the ink removed from the fountain is not transferred in the form of a thin ink film and the risk of the film surface drying out is substantially reduced.

It is further provided that the cam disc be connected with an indexing or ratchet wheel which is drivable stepwise by means of a pawl. This makes it possible to drive the fountain roller independently of the cycle of the press, so that the ink dosing of the individual inking mechanisms can be adjusted separately, in accordance with the respective instantaneous need.

Since the pawl is hinged to a pivotal lever mounted on the supporting frame and is actuated, in the working position of the respective inking mechanism directly, by an actuating mechanism performing an oscillatory motion, the further advantage is obtained that only a single drive member is needed to drive the fountain roller of the respective inking mechanism which is just in its working position, and that it is possible to dispense with complicated drive mechanisms for the fountain roller.

A further important feature of the invention is that the applicator roller is separately mounted, for radial displacement against the action of a spring, on two supporting plates which are hinged in the supporting frame to a common shaft, and can be displaced in the working position of the respective inking mechanism, along the circumference of the spreader roller, by means of a lever mechanism actuable through a program control shaft carrying cams, and relative to the plate cylinder between a contact position and an off position.

Here again, the means and measures for a functionally correct contacting and lifting of the applicator roller of the respective inking mecchanism occupying its working position are reduced to a minimum adequate to the rugged construction. In addition, in the inventive design, the applicator roller can be brought into contact with, or lifted from, the plate cylinder, by means of a very simple transmission, from the program control shaft of the press which is provided anyway.

Since the spreader roller of each inking mechanism is to be driven only as long as the respective inking mechanism occupies its working position and has to stand still in any other position of that mechanism, a further development of the invention provides that the spreader roller of each inking mechanism carries a gear meshing with a drive gear and that bearing of this drive gear is mounted on one of the supporting discs at such a location that in the working position of the respective inking mechanism, the axis of the bearing coincides with the connecting line between the axis of the plate cylinder and the axis of rotation of the supporting frame, and that the drive gear is engaged with a gear which is driven along with the plate cylinder.

Accordingly, it is an object of the invention to provide a printing press, particularly a rotary offset office printing press, which comprises a plate cylinder over which material to be printed is passed and with an inking mechanism support member or cylinder mounted adjacent the plate cylinder which has a plurality of separately inking mechanisms mounted thereon at circumferentially spaced locations. The support member is rotatable to present a separate one of the mechanisms in cooperative engagement with the plate member over which the material to be presented is passed. The inking mechanism includes an ink fountain, a fountain roller cooperatively associated with the ink fountain for picking up ink therefrom, a spreader roller cooperatively engageable with the fountain roller to remove ink from the fountain roller and to transfer it to an application roller which is positionable between the spreader roller and the support cylinder for applying ink picked up from the spreader roller onto the application roller and then onto the material to be inked.

Another object of the invention is to provide an inking mechanism which is associated with a plurality of mechanisms on a movable support and which includes an ink fountain in the form of a tube having a segmental opening in its periphery and which includes a fountain roller mounted adjacent the ink fountain with means for shifting the ink fountain so that its periphery may be juxtaposed over the periphery of the socket roller and sealed thereby.

Another object of the invention is to provide a printing press which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embdoment of the invention.

BRIEF DESCRIPTION OF THE DRAWINGS

In the Drawings:

FIG. 3 shows the inking mechanism of FIG. 2, but minus the drive for the fountain roller;

FIG. 4 shows the gear drive for the spreader roller of the inking mechanism of FIGS. 2 and 3;

FIGS. 5, 6 and 7 show the inking mechanism of FIGS. 2 and 3, with the ink fountain in different operational positions;

FIG. 9 is a developed showing of the arrangement of the applicator roller, the fountain roller, and the ink fountain, with the corresponding bearing and actuating means.

DESCRIPTION OF THE PREFERRED EMBODIMENT

Figure 1:
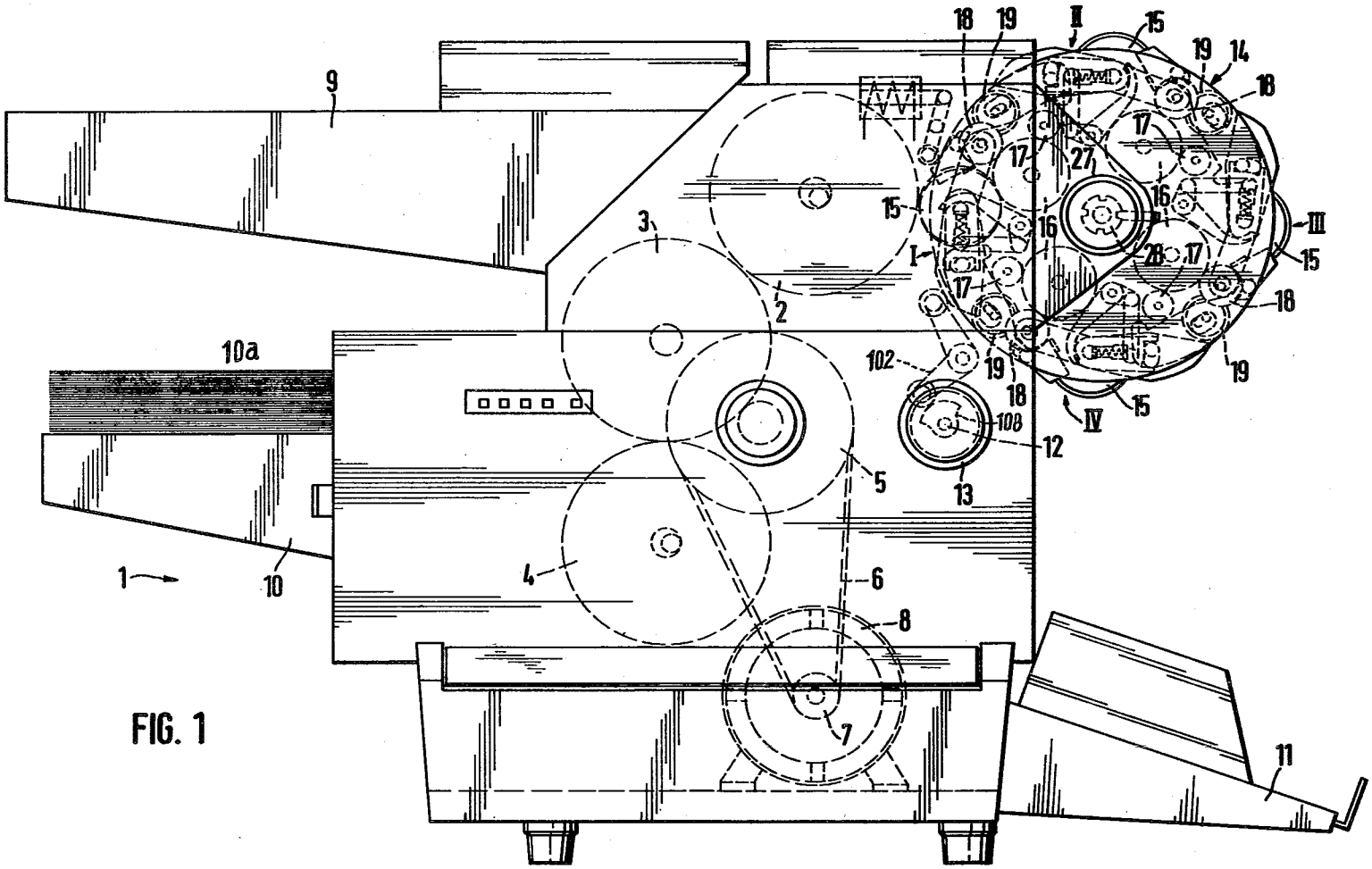
FIG. 1 is a side elevational view of an office offset printing press, constructed in accordance with the invention.

Referring to the drawings in particular, the invention embodied therein, comprises a rotary printing press which comprises a plate member, such as a plate cylinder 2 over which articles 10*a* which are to be printed are directed and which is positioned so that it may be oriented for cooperable engagement with one or more inking mechanisms I, II, III and IV, which may be selectively cooperably positioned in respect to the plate cylinder 2. The feature of the invention is that each inking mechanism includes an ink fountain in the form of a tubular member having a portion of its periphery cutout to receive a cylindrical fountain roller so that the ink contained in the ink fountain tube 19 may be positioned to be picked up by a fountain roller 18 which may be positioned in cooperative engagement therewith as shown in FIG. 3.

The basic design of the office offset printing press 1 diagrammatically shown in FIG. 1 in a side elevational view corresponding to that of a conventional office offset printing press. Consequently, the press comprises a plate cylinder 2, a rubber blanket cylinder 3, and an impression cylinder 4, which are conjointly driven by an electric motor 8, through belt transmissions 5, 6, 7.

The press further includes an automatic feeder 9 for feeding the master prints to the plate cylinder; a rising table 10 for feeding the sheets 10*a* to be printed, and a delivery table 11 for receiving the printed sheets.

Press 1 is also equipped with a program control shaft 12 carrying a control button 13 which is actuable both manually and automatically. The standard equipment of an up-to-date office offset printing press also comprises, aside from the parts just mentioned, a water mechanism as well as other different control mechanisms (not shown). The office offset printing press 1 shown is further equipped, unlike the conventional design, with four altogether quite identically designed inking mechanisms I to IV which are accommodated in a common supporting frame 14.

Each of inking mechanisms I through IV comprises an inking or applicator roller 15, a spreader roller 16 for spreading the ink by rubbing, a distributor roller 17 resiliently applying to the circumference of spreader roller 16, a fountain roller 18, and an ink fountain 19. The further parts and mechanisms belonging to each inking mechanism will be dealt with hereinafter, with reference to FIGS. 2 through 9.

Supporting frame 14 comprises two circular supporting discs 20 and 21 (FIG. 8) which are spaced apart by a distance corresponding to the width of an inking mechanism and are secured to a common shaft 22. Shaft 22 is mounted for rotation on two supporting plate bars 23, 24 of the machine frame 25, 26 and provided with a control knob 27. In order to be able to fix the individual inking mechanisms I–IV in their working positions in which each respective applicator roller 15 can be applied to plate cylinder 2, shaft 22 is equipped with a star wheel 28 having four index notches 29 (FIG. 3) circumferentially equidistantly spaced from each other into which a lock bolt 30 is detachably engaged.

Figure 8:
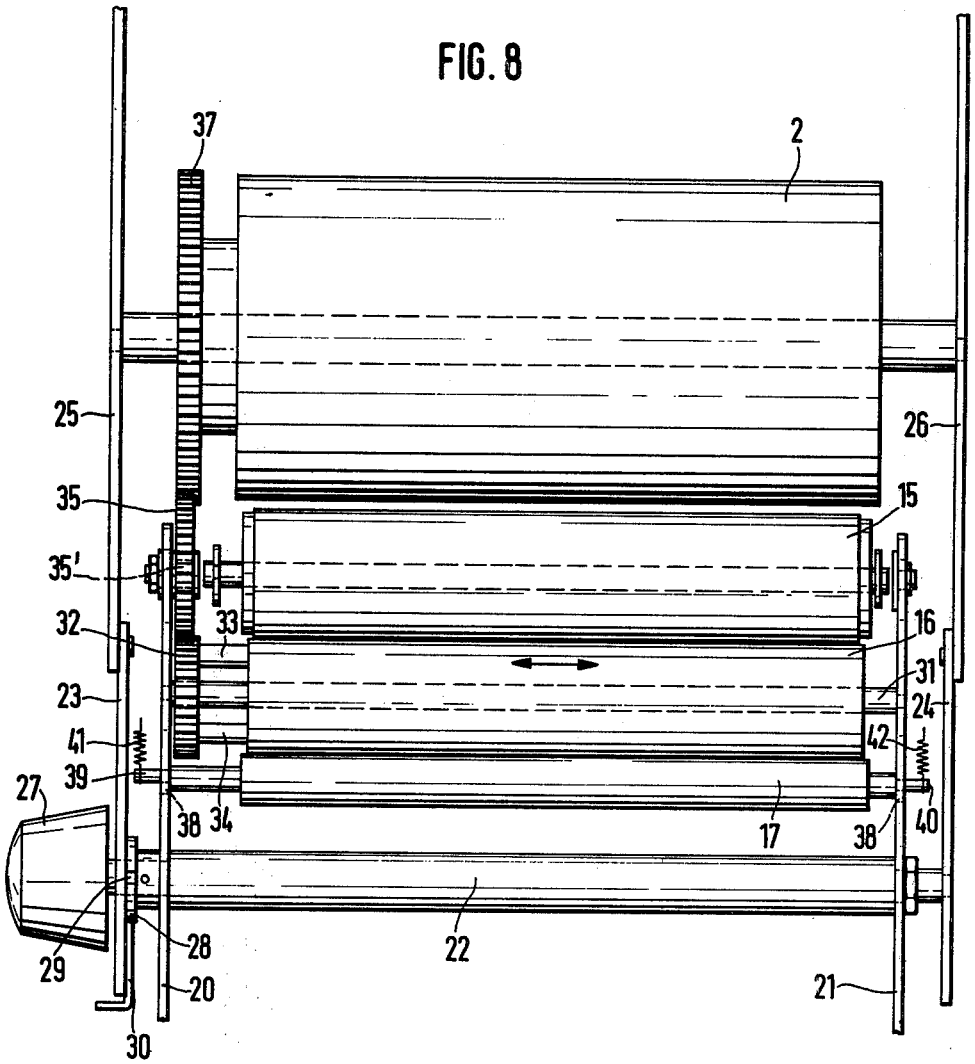
FIG. 8 is a diagrammatical top plan vidw of the arrangement of the applicator roller and the spreader roller of the inking mechanism shown in FIGS. 2 and 3.

As may be learned from the drawing, ink fountains 19, fountain rollers 18, and applicator rollers 15 of each inking mechanism I–IV are disposed close to the circumference of supporting discs 20 and 21, while the spreader rollers 16 which each contact both the associated fountain roller 18 and the applicator roller 15 are mounted closer to shaft 22 of supporting frame 14. Spreader roller 16 is mounted for axial and rotary motion on a shaft 31 which is fixedly mounted on supporting discs 20, 21 and which further carries a gear 32. Gear 32 is connected to spreader roller 16 by means of two coupling pins 33 and 34 (FIG. 8). The device effecting the axial motion of the spreader roller, and which has not been shown, is of a conventional design. Gear 32 meshes with a drive gear 35. Drive gear 35 is mounted for rotation on a fixed journal pin 35' of supporting disc 20, close to the circumference of the disc and at such a location that in the working position of the respective inking mechanism I–IV, its axis of rotation coincides with the connecting dash-dotted line 36 in FIG. 4, between the axis of shaft 22 and the axis of rotation of plate cylinder 2, and that, again in the working position of the respective inking mechanism I–IV, gear 35 engages a gear 37 which is connected to plate cylinder 2.

Distributor roller 17 which has the sole purpose of uniformly distributing the ink transferred by fountain roller 18 to spreader roller 16 over the surface of spreader roller 16, is mounted for radial motions in slots 38 (FIG. 8) which are provided in supporting discs 20, 21 and extend radially of spreader roller 16 and is pressed against the circumference of spreader roller 16 by tension springs 41, 42 which act on journal pins 39, 40. Distributor roller 17 is driven by the frictional contact on spreader roller 16.

Figure 2:
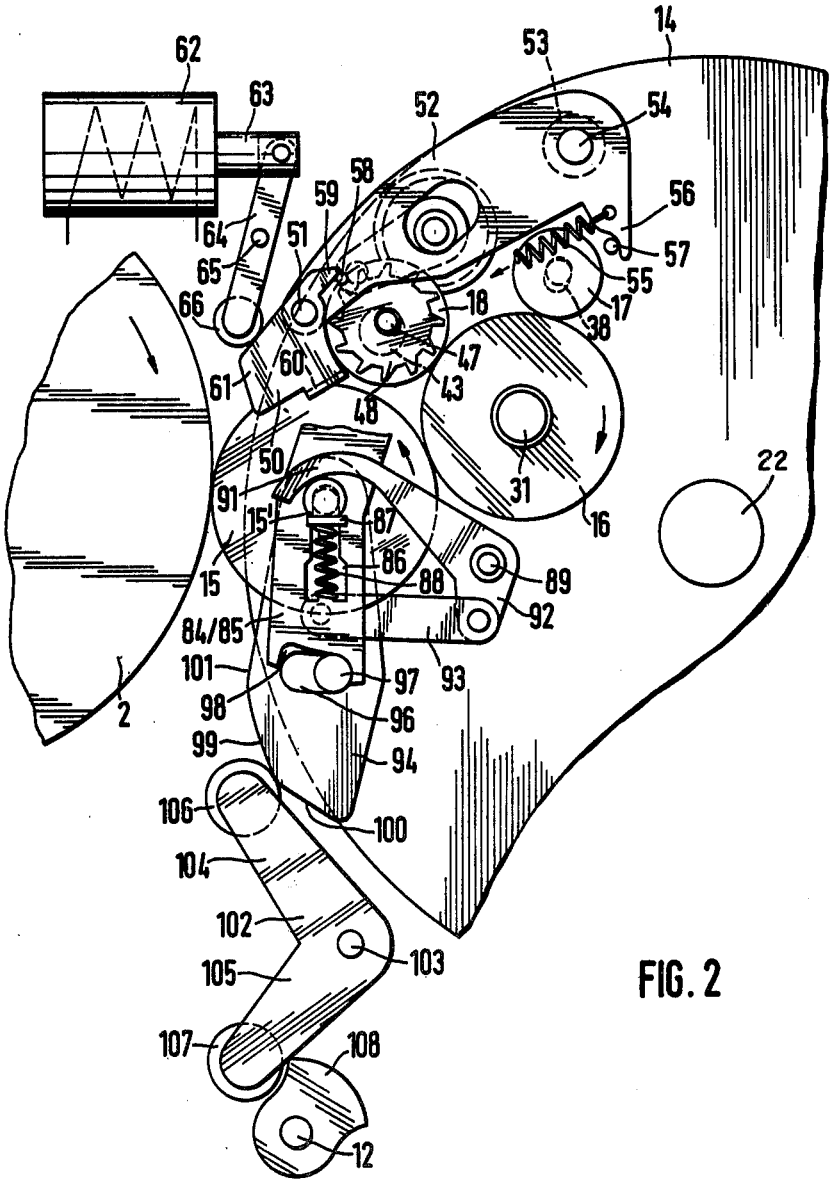
FIG. 2 is a partial view of the frame supporting the inking mechanism, showing the inking mechanism in its working position.

In order to enable the adjustment of the ink transfer from fountain roller 18 to spreader roller 16 to the instantaneous consistency of the ink, fountain roller 18 is mounted for radial displacement relative to spreader roller 16, by means of two eccentric pins 43 and 44 (FIGS. 2 and 9). Eccentric pins 43 and 44 are displaceably secured to supporting discs 20, 21 by means of unscrewable nuts 45, 46 and they carry conjointly the shaft 47 of fountain roller 18 which is not aligned with their common axis (see FIG. 9). The left end portion 47' of shaft 47 of roller 18 carries an indexing wheel 48 which is non-rotatably mounted thereon and is connected to a cam disc 49 also carried on shaft end 47' (See FIGS. 5 to 7 and 9). For the stepwise drive of fountain roller 18, a pawl 50 is provided which cooperates with indexing wheel 48 and is hinged, by means of a journal pin 51 with the free end of a pivotal lever 52. Lever 52 is mounted, near the circumference and by means of a bushing 53, for rotation on a cylindrical rod 54 connecting the two supporting discs 20 and 21 (see FIGS. 2 and 9), and is acted upon by a tension spring 55 which pulls a projecting nose 56 of lever 52 against a stop 57 which is secured to supporting disc 20. The action of tension spring 55 is oriented so that the arm carrying pawl 50 of pivotal lever 52 is urged radially outwardly relative to the axis of rotation of supporting frame 14 and also relative to index wheel 48.

Pawl 50 has a guide finger portion 59 applying against a fixed pin 58 and, at the opposite side, it has an angled indexing tongue 60 as well as a triangular back portion 61 which, in the rest position of supporting disc 20, projects radially outwardly beyond the circumference thereof. Pawl 50 is actuated by an electromagnet 62, the armature 63 of which is hinged to a two-arm lever 64. Lever 64 is mounted for pivoting about a fixed stud 65 of machine frame 25 and is provided at its free end with a roller 66 which acts on the back portion 61 of pawl 50 (FIG. 2).

Lever 64 is caused to pivot counterclockwise about stud 65 by energizing electromagnet 62. This first rotates pawl 50 about journal pin 51 of lever 52, so that indexing tongue 60 engages indexing wheel 48. Then, along with lever 52, pawl 50 executes a further pivotal motion to index the wheel 48 through somewhat more than one tooth pitch. At the end of the energizing pulse of electromagnet 62, it is returned into its initial position shown in FIG. 2. The switching sequence of electromagnet 62 is adjustable by means of an electrical pulse generator (not shown). In consequence, the dosed quantity of ink transferred from inking roller 18 to spreader roller 16 is adjustable. The pulse generator energizing electromagnet 62 may operate independently of the cycle of the press.

Since the individual inking mechanisms I–IV are supported in a rotary frame and, consequently, may occupy positions in which the ink fountains are also turned upside down, only closed ink fountains can be provided for these inking mechanisms. For this reason, in the embodiment shown, the ink fountains 19 each comprise a cylindrical tube 67 which is closed at both its front sides and provided with a cutout 68 extending over the entire length of the tube and conformable to the circumferential shape of inking roller 18, so that the bounding edges of cutout 68 tightly contact the circumference of inking roller 18 both frontally and alongside the roller, as shown in FIGS. 2, 3 and 6. Thus, inking roller 18 projects segmentally into tube 67 constituting ink fountain 19 and, in the working position of the respective inking mechanism I–IV, has a permanent contact with the ink 69 contained in tube 67.

As may be seen from FIGS. 5 to 7 and 9, tube 67 is provided on its front sides with concentrically located, coaxial, stub shafts 70, 71, the journal pins 72, 73 of which are of smaller diameter and movably received in slots 74, 75 of supporting discs 20, 21, which slots extend radially of inking roller 18. Journal pins 72, 73 are attached to tension springs 76, 77 which press tube 67 against inking roller 18. A lever arm 79 is secured to stub shaft 70 by means of a bushing 78, and the free end of arm 79 carries a feeler roll 80 projecting into the path of motion of cam disc 49. The arrangement of lever arm 79 is such that feeler roll 80 is located at the same side of the connecting line between the axis of inking roller 18 and the axis of tube 67 as the exit boundary edge 81 of cutout 68 of tube 67, considered in the direction of rotation of inking roller 18.

The operation of the device and cooperation of lever arm 79 and tube 67 with cam disc 49 or inking roller 18 is illustrated in FIGS. 5, 6 and 7. As already mentioned, the bounding edges of cutout 68 of tube 67 contact, in their normal position, tightly the surface of inking roller 18, so that no ink can escape from ink fountain 19.

Due to the stepwise rotary motion of cam disc 49 which takes place in synchronism with the rotary motion of inking roller 18 and is actuated by electromagnet 62 in the manner described above, lever arm 79 is intermittently pivoted, by the cams of cam disc 49, in the clockwise direction (considering FIGS. 5 to 7), whereby, the exit edge 81 of the cutout 69, as shown in FIG. 7, is lifted from inking roller 18, so that during the simultaneous rotary motion of inking roller 18, an ink drop extending over the entire length thereof can form on the surface of inking roller 18 and leave tube 67 or ink fountain 19. In the course of the following stepwise motions of inking roller 18, this ink drop 82 is transferred into the contact zone betweeen inking roller 18 and spreader roller 16 where, during the working phase of the respective inking mechanisms I–IV, a supply drop 83 is always to be present. An ink film corresponding to the gap provided between inking roller 18 and spreader roller 16 is formed on the surface of spreader roller 16 and the film is then removed by an applicator roller 15 and transferred to plate cylinder 2 or the printing plate.

As may be seen in FIG. 5, because of the resilient rotary mounting of tube 67 in slots 74, 75 of supporting discs 20, 21, tube 67 can also turn to a position in which cutout 68 is on the top side and open (FIG. 5). In this position of tube 67, ink may be easily refilled. Emptying and cleaning of ink fountain 19 may also take place in this position.

As is well known, the design must be such that before and after each printing operation, the applicator roller can be lifted from the plate cylinder, to make certain that the applicator roller is sufficiently inked and also to prevent the applicator roller from applying ink to the blank plate cylinder, i.e., one which is not provided with a printing plate. To comply with this requirement, shaft 15' of the applicator roller 15 of each inking mechanism I–IV is mounted on two supporting plates 84, 85 (FIG. 2) which, in turn, are pivotally mounted on eccentric pins 43, 44. Each supporting plate 84, 85 is provided with oblong openings or slots 86 in which backing plates 87 movable within the slots and compression springs 88 are received against which the ends of shaft 15' of applicator roller 15 are applied.

Slots 86 and compression springs 88 extend approximately perpendicularly to the connecting line 36 shown in FIG. 4 between the axis of rotation of supporting frame 14 and the axis of rotation of plate cylinder 2, as long as the respective inking mechanism occupies its working position shown in FIGS. 2 and 3. This makes it possible to move applicator roller 15 from its contact position shown in FIG. 2 in which it is applied to plate cylinder 2, into its lifted position shown in FIG. 3, with roller 15 still maintaining its contact with spreader roller 16. The contact between applicator roller 15 and plate cylinder 2 is effected by compression springs 88 of the two supporting plates 84, 85.

To lift applicator roller 15 from plate cylinder 2, two arcuate levers 90 and 91 are provided which are secured to a common shaft 89 mounted for rotation in supporting discs 20, 21 and bear against the two ends of shaft 15'. Lever 91 is provided with a second, shorter, lever arm 92 to which a link 93 is hinged connecting to a guide lever 94. Guide lever 94 is pivoted to a pin 95 which is fixed to supporting disc 21 approximately coaxially of shaft 15'. The pivotal motion of lever 94 is limited by an arcuate slot 96 and a stop pin 97 projecting therein. Stop pin 97 at the same time serves to limit the motion of the two supporting plates 84, 85 of which at least one is provided at its lower end with a corresponding recess 98. Guide lever 94, which extends approximately parallel to the lower part of supporting plates 84, 85, comprises an arcuate edge portion 99 which, in the contact position of applicator roller 15, extends outside the circular circumference of supporting disc 21 and which is followed, at either side, by edge portions 100, 101 extending inwardly in a radially oblique direction.

To actuate guide lever 94, an angle lever 102 (FIG. 3) is provided which is pivoted to a journal pin 103 fixed to the press frame and the lever arms 104, 105 of which are each provided with rollers 106, 107. The arrangement is such that with the respective inking mechanism in working position, roller 106 of lever arm 104 applies against arcuate edge portion 99 of guide lever 94 and roller 107 of lever arm 105 iw within the range of action of a rotary cam plate 108 secured to the program control shaft 12 of the press. In FIG. 2, the program control shaft and its cam plate 108 are in the position "printing" which means that applicator roller 15 and plate cylinder 2 are in contact.

If, on the other hand, program control shaft 12 and cam plate 108 are turned into the position shown in FIG. 3, which they occupy, for example, during the inking operation preceding the printing, guide lever 94 is pivoted, by a corresponding pivotal motion of angle lever 102, from its position shown in FIG. 2 into its position shown in FIG. 3. This motion of guide lever 94 is transmitted, through connecting link 93, to arcuate levers 91 and 92 and, therefrom, to shaft 15', so that applicator roller 15 is lifted from plate cylinder 2. The opposite motions of these parts, i.e., from the lifted position into the contact position, are effected by compression springs 88.

The length of arcuate edge portion 99 of guide lever 94 is dimensioned so as to ensure that during a rotation of supporting frame 14 through 90° for changing the ink, i.e., for bringing inking mechanism into the working position, applicator roller 15 remains in its lifted position both while the used inking mechanism I–IV is moved away from and while the new inking mechanism is moved into the working position, and that it does not touch the plate cylinder during any of these motions. In this connection, it must be kept in mind that such a rotation of supporting frame 14 takes place always only in the position shown in FIG. 3 of program control shaft 12, in which guide lever 94 is pushed by angle lever 102 inwardly and applicator roller 15 is or is being lifted.

The four inking mechanisms I–IV mounted in supporting frame 14 at angularly equidistantly spaced locations make possible both a multicolor printing with the three basic colors blue, yellow, red and black printing in which three of the inking mechanisms provided carry each one of the basic colors and the fourth inking mechanism contains black ink.

Advantageously, there is an automatic or semi-automatic drive (not shown) and the frame 14 is supported for rotation so as to bring the individual inking mechanisms I–IV selectively into the working position, in the same manner as in the case of turret heads of machine tools or the like.

It may also be learned from the embodiment shown that the four inking mechanisms I–IV can be operatively accommodated in a very rugged fashion, i.e., with a minimum of required space, and that the invention may be easily applied also for additionally equipping office offset printing presses or other rotary printing presses which hitherto had only a single inking mechanism.

While a specific embodiment of the invention has been shown and described in detail to illustrate the application of the principles of the invention, it will be understood that the invention may be embodied otherwise without departing from such principles.

What is claimed is:

1. A printing press comprises a plate member over which material to be printed is passed, an inking mechanism support member located adjacent said plate member, a plurality of separate inking mechanisms mounted on said support member each including an ink fountain, a fountain roller cooperatively associated with said ink fountain for picking up ink therefrom, a spreader roller cooperatively engageable with said fountain roller to pick up the ink therefrom, and an application roller positioned between said spreader roller and said plate member for applying ink from said spreader roller to the material passed over said plate member, and mounting means mounting said ink mechanism support member with the individual ink mechanism for positioning a selective one of said mechanisms with its application roller is cooperative engagement with said plate member, said closed in fountain having an opening in the periphery thereof defining a circular cutout, said ink fountain roller being engageable in the cutout opening, said fountain having a longitudinal edge, means mounting said fountain and said fountain roller for relative movement of said fountain roller and said fountain toward and away from each other, a rotatable cam disc adjacent said fountain engageable with said fountain to move it toward and away from said fountain roller and a lever arm supporting said fountain for shifting movement relative to said fountain roller.

2. A printing press, according to claim 1, including a ratchet wheel, a pawl which is intermittently driven connected to said ratchet wheel to index said ratchet wheel, said ratchet wheel being connected to said cam disc to move said cam disc for displacing said fountain and said fountain roller relatively.

3. A printing press, according to claim 2, including a supporting frame, a lever pivotally mounted on said supporting frame, a pawl hinged to said lever, and a actuating mechanism acting directly on said pawl and drivable in an oscillating motion for indexing the respective inking mechanism in respect to said supported frame.

4. A printing press comprises a plate member over which material to be printed is passed, an inking mechanism support member located adjacent said plate member, a plurality of separate inking mechanisms mounted on said support member each including an ink fountain, a fountain roller cooperatively associated with said ink fountain for picking up ink therefrom, a spreader roller cooperatively engageable with said fountain roller to pick up the ink therefrom, and an application roller positioned between said spreader roller and said plate member for applying ink from said spreader roller to the material passed over said plate member, and mounting means mounting said ink mechanism support member with the individual ink mechanism for positioning a selective one of said mechanisms with its application roller in cooperative engagement with said plate member, wherein said ink fountain comprises a tube having each end closed and having a cutout portion at its periphery extending along its entire length and conformable to the circumference of said fountain roller, means for mounting said ink fountain for rotation relative to said fountain roller and for radial movement with respect to said fountain roller, and spring means biasing said ink fountain towards said fountain roller.

5. A printing press comprises a plate member over which material to be printed is passed, an inking mechanism support member located adjacent said plate member, a plurality of separate inking mechanisms mounted on said support member each including an ink fountain, a fountain roller cooperatively associated with said ink fountain for picking up ink therefrom, a spreader roller cooperatively engageable with said fountain roller to pick up the ink therefrom, and an application roller positioned between said spreader roller and said plate member for applying ink from said spreader roller to the material passed over said plate member, and mounting means mounting said ink mechanism support member with the individual ink mechanism for positioning a selective one of said mechanisms with its application roller in cooperative engagement with said plate member, wherein said ink fountain comprises a tube having each end closed and having a cutout portion at its periphery extending along its entire length and conformable to the circumference of said fountain roller, means separately mounting said application roller on said support member, including a common shaft, a pair of support plates hinged to said common shaft for radial motion, spring means biasing said support plates against movement toward engagement with said plate member and along the circumference of said spreader roller, said means comprising a lever mechanism, a program control shaft carrying cams connected to said lever mechanism for shifting said lever mechanism and said application roller between a contact position with said plate member and a lifted position.

6. A printing press comprises a plate member over which material to be printed is passed, an inking mechanism support member located adjacent said plate member, a plurality of separate inking mechanisms mounted on said support member each including an ink fountain, a fountain roller cooperatively associated with said ink fountain for picking up ink therefrom, a spreader roller cooperatively engageable with said fountain roller to pick up the ink therefrom, and an application roller positioned between said spreader roller and said plate member for applying ink from said spreader roller to the material passed over said plate member, and mounting means mounting said ink mechanism support member with the individual ink mechanism for positioning a selective one of said mechanisms with its application roller in cooperative engagement with said plate member, wherein said ink fountain comprises a tube having each end closed and having a cutout portion at its periphery extending along its entire length and conformable to the circumference of said fountain roller, a drive gear, a pinion connected to said spreader roller and driven by said drive gear, said support member comprising a support disc supporting each of said inking mechanisms, said drive gear being mounted on said support disc at a location such that the working position of a respective mechanisms on said application roller thereof is in contact with said plate member and is such that its axis coincides with a connecting line between the axis of said plate member and the axis of said supporting disc, said member comprising a rotatable plate cylinder, and means for driving both said plate cylinder and said drive gear.

* * * * *